US008783642B2

(12) United States Patent
Pedersen

(10) Patent No.: US 8,783,642 B2
(45) Date of Patent: Jul. 22, 2014

(54) METHOD AND OBJECT FOR FASTENING OF POSTERS

(75) Inventor: Tomas Pedersen, Støvring (DK)

(73) Assignee: Magsee GmbH, Bad Nauheim (DE)

( * ) Notice: Subject to any disclaimer, the term of this patent is extended or adjusted under 35 U.S.C. 154(b) by 232 days.

(21) Appl. No.: 13/579,524

(22) PCT Filed: Aug. 16, 2010

(86) PCT No.: PCT/DK2010/000116

§ 371 (c)(1),
(2), (4) Date: Aug. 17, 2012

(87) PCT Pub. No.: WO2011/026491

PCT Pub. Date: Mar. 10, 2011

(65) Prior Publication Data

US 2012/0305737 A1 Dec. 6, 2012

(30) Foreign Application Priority Data

Sep. 1, 2009 (DK) ..... 2009 00983

(51) Int. Cl.

| | |
|---|---|
| ***G09F 15/02*** | (2006.01) |
| ***G09F 11/29*** | (2006.01) |
| ***G09F 7/04*** | (2006.01) |
| ***G09F 15/00*** | (2006.01) |
| *G09F 7/18* | (2006.01) |

(52) U.S. Cl.

CPC ..... *G09F 11/29* (2013.01); *G09F 2007/186* (2013.01); *G09F 7/04* (2013.01); *G09F 15/0062* (2013.01)

USPC ..... 248/467; 40/514; 40/658

(58) Field of Classification Search

CPC ..... G09F 7/94; G09F 7/18; G09F 15/0062; G09F 15/0018; G09F 2007/186; G09F 11/29; Y10S 40/904

USPC ..... 248/489, 492, 317, 467, 683, 206.2; 40/658, 603, 617, 649, 666, 753, 514

See application file for complete search history.

(56) References Cited

U.S. PATENT DOCUMENTS 4,511,211 A 4/1985 Runyan
4,525,946 A * 7/1985 Olson ..... 40/514

(Continued)

FOREIGN PATENT DOCUMENTS

EP 1093106 A2 4/2001
EP 1285421 A 3/2008

(Continued)

OTHER PUBLICATIONS

International Search Report, for PCT/DK2010/000116, mailed Nov. 30, 2010, 2 pages.

(Continued)

*Primary Examiner* — Anita M King

(74) *Attorney, Agent, or Firm* — William J. Sapone; Ware Fressola; Maguire & Barber LLP

(57) ABSTRACT

A method for fastening items (2) such as posters, photos or banners, which in the edge for hanging have a poster hanging bar or rail (3) manufactured from a magnetic material, to an object such as a poster roll up unit (15), which is provided with one or more magnets (5) to which the rail (3) can be connected, the magnets (5) being placed in a recess in relation to the object's surface. Poster roll up units (15) are provided with built in magnets (5) for fastening and fixing items (2) by magnetic connection between the magnets (5) and the rail (3), mounted in the item's (2) edge for hanging. Items such as posters are simply, inexpensively and efficiently mounted and fastened to objects such as poster roll up units (15), without safety risks and requirements for space.

13 Claims, 3 Drawing Sheets

(56) References Cited

U.S. PATENT DOCUMENTS

| | | | | |
|---|---|---|---|---|
| 5,011,102 | A * | 4/1991 | Kiefer | 248/37.3 |
| 6,038,800 | A * | 3/2000 | Seidel | 40/517 |
| 6,170,182 | B1 * | 1/2001 | Skypala | 40/514 |
| 6,305,109 | B1 * | 10/2001 | Lee | 40/546 |
| 6,474,009 | B2 * | 11/2002 | Hahn | 40/658 |
| 7,159,347 | B1 * | 1/2007 | Ngan | 40/514 |
| 7,296,373 | B1 * | 11/2007 | Hahn | 40/617 |
| 2002/0133992 | A1 * | 9/2002 | Wu | 40/661.01 |
| 2008/0005945 | A1 | 1/2008 | Fritsche | |
| 2008/0023605 | A1 * | 1/2008 | Yang | 248/261 |
| 2008/0202007 | A1 * | 8/2008 | Suciu et al. | 40/658 |
| 2011/0210219 | A1 * | 9/2011 | Pedersen | 248/231.91 |

FOREIGN PATENT DOCUMENTS

| | | | | |
|---|---|---|---|---|
| WO | WO03/074808 | A1 | 9/2003 | |
| WO | WO 2008119348 | A1 * | 10/2008 | G09F 15/02 |

OTHER PUBLICATIONS

Supplemental European Search Report for corresponding EP application No. EP 10 81 3370.3, completed May 29, 2013, 2 pages.

* cited by examiner

METHOD AND OBJECT FOR FASTENING OF POSTERS

CROSS-REFERENCE TO RELATED APPLICATIONS

This application is a U.S. national Stage of PCT International application no. PCT/DK2010/000116, filed 16 Aug. 2010, which claims priority in Danish patent application no. PA 2009000983, filed 1 Sep. 2009, which are hereby incorporated by reference.

TECHNICAL FIELD

The invention relates to a method for fastening of items such as posters, photos or banners, which in the edge for hanging are provided with a poster hanging bar or rail for an object.

The invention also relates to an object such as a top fixture or a roll up unit for fastening of items such as posters, photos or banners, which in the edge for hanging are provided with a rail manufactured and produced by a magnetic material such as iron.

The invention also relates to the application of a method.

BACKGROUND

From EP1285421, there is known a technique for hanging of items such as posters, which in the edge for hanging are provided with a rail.

With the known technique, the rail is guided and put into a slit in the side of an object consisting of a roll up unit, whereafter the hanging rail is fixed in a mechanical bed or slit, which is shaped in such a way that it can fix the rail when the poster is rolled up and out.

It has been found, however, that this known technique involves some drawbacks, including that the poster, which is to be hanged, is easily damaged when it is inserted sideways in a roll up unit through slits in the end surfaces of the roll up unit.

Moreover, the necessary sideways movement at insertion and removal of posters in the roll up unit is space demanding since the operations demand a total width, which as a minimum corresponds to the poster roll up unit's width and the poster's width.

This demand for width often limits use of the technique in space-limited applications.

Furthermore, it has been found that there can be a safety problem with the slit in the side of the poster roll up unit where especially the fingers of children can be stuck.

From EP 1093106 A2 is furthermore known a roll up unit, which consists of a cylinder, which is on the surface provided with magnets for fastening a poster, which is to be rolled up.

It has been found, however, that rolling up posters around a cylinder, which has magnets mounted on the surface has drawbacks, including that the poster is deformed at the magnets caused by mechanical pressure from these.

SUMMARY OF THE INVENTION

It is therefore an object of the invention to improve the known method and object including poster roll up unit and top fixture for fastening items such as posters.

The object of the invention is achieved by a method for fastening of items such as posters, photos or banners, which in the edge for hanging are provided with a poster hanging bar or rail for an object, which is characterized in that the rail is produced from a magnetic material and that the object to which the item is to be fastened, is provided with one or more magnets for magnetic connection with, and thereby fastening of, the rail where the magnets are placed in a recess in relation to the object's surface.

In this way it thus becomes possible to avoid space-demanding transverse fitting of posters in e.g. poster roll up units.

The advantage is also achieved that poster roll up units can be produced and manufactured without an open slit in the side whereby the safety risk from this is eliminated.

Further appropriate embodiments of the method are characterized in that fastening of an item to an object occurs by leading and guiding the rail to magnetic contact with the magnets.

As mentioned, the invention also relates to an object.

This object is characterized in that the object is provided with one or more magnets, to which the rail can be connected, where the magnets are placed in a recess in relation to the object's surface.

Hereby it becomes possible to fit and mount a poster in e.g. a poster roll up unit without application of sideways insertion, whereby the requirements for space to the surroundings in relation to the hitherto known technique is removed.

Also, the object can be manufactured with closed side surfaces whereby potential safety risks of finger damages are eliminated.

The invention also relates to the application of method for fastening of items such as posters, photos or banners for objects including top fixtures or roll up units.

BRIEF DESCRIPTION OF THE DRAWINGS

The invention will now be explained more fully with reference to the drawings, in which.

DETAILED DESCRIPTION OF THE INVENTION

Figure 1:
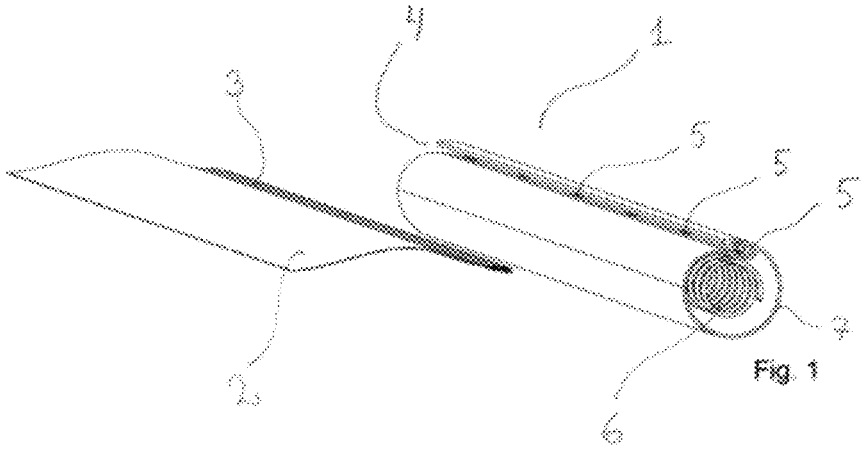
FIG. 1 shows, seen obliquely from the side, a poster with an edge poster hanging bar, which is to be wound up into a roll up unit, which is provided with magnets, which is placed in a recess in relation to the surface.

In FIG. 1 there is shown a roll up part 1 of a so-called poster roll up unit.

The roll up part 1 is internally provided with a spring 6, which powers the roll up.

Also, the roll up part or unit 1 is enclosed by a preferably circular housing 7, which in the width of the roll up unit is provided with a crevice 4, in which there are placed a number of magnets 5.

FIG. 1 also shows an item 2, consisting of a poster, photo or a banner, which in a side or an edge is provided with a rail 3, which is manufactured from a magnetic material such as iron.

The item 2 can, by insertion in the roll up unit's crevice 4, be fastened to the roll up unit 1 by magnetic connection between rail 3 and the magnets 5.

Insertion of the item 2 in the roll up unit 1 can thus occur by a direct connection between the two components without requirement for a preceding sideways movement, which is known from the technique described in EP1285421.

Figure 2:
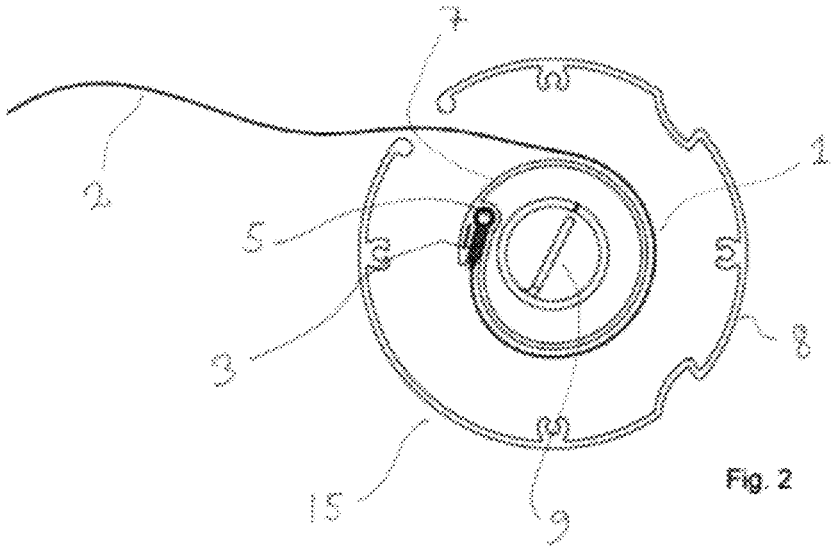
FIG. 2 shows, in a cross-section, a poster, equipped with a rail produced by a magnetic material, which is placed and partially rolled up in a poster roll up unit, which is provided with magnets for fastening the poster rail, which is placed in a recess in relation to the surface.

In FIG. 2 is shown a cross section of an object consisting of a poster roll up unit 15, which includes a roll up part 1 mounted in a partially enclosed housing 8, where an item 2 such as a poster is inserted and partially rolled up in the roll up part 1.

It is furthermore illustrated in FIG. 2 that the item 2 is fastened to the roll up part 1 by contact between the rail 3 and the magnet 5, where the force of attachment or connection between the two parts is made possible by magnetic connection.

Figure 3:
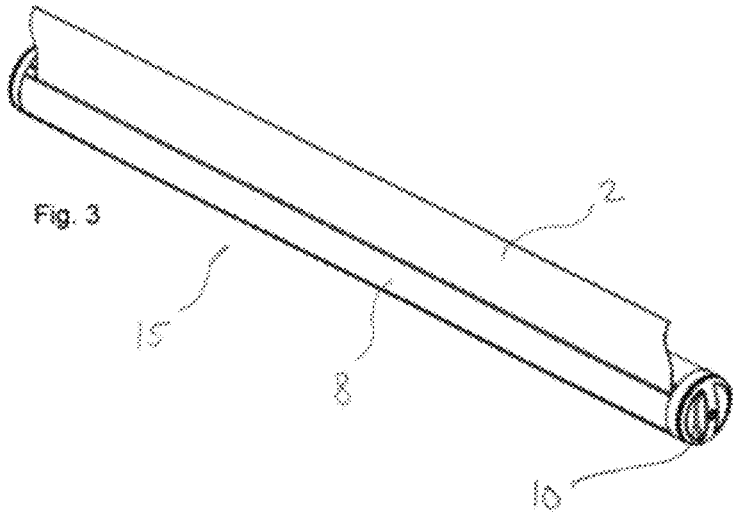
FIG. 3 shows, viewed obliquely from the side, a poster which is rolled up into a poster roll up unit where the poster roll up unit is closed at the ends, and thus does not have a slit that may pose a safety risk.

FIG. 3 shows an object consisting of a poster roll up unit 15 with a partially rolled up item 2 consisting of e.g. a poster, where it can be seen that the end 10 of the poster roll up unit 15 is closed and has a handle 9 extending therefrom, and the unit is therefore not manufactured with a slit for sideways insertion of posters, as it is known from EP1285421, where the slit, among other problems, can pose a potential safety risk for the users.

Figure 4:
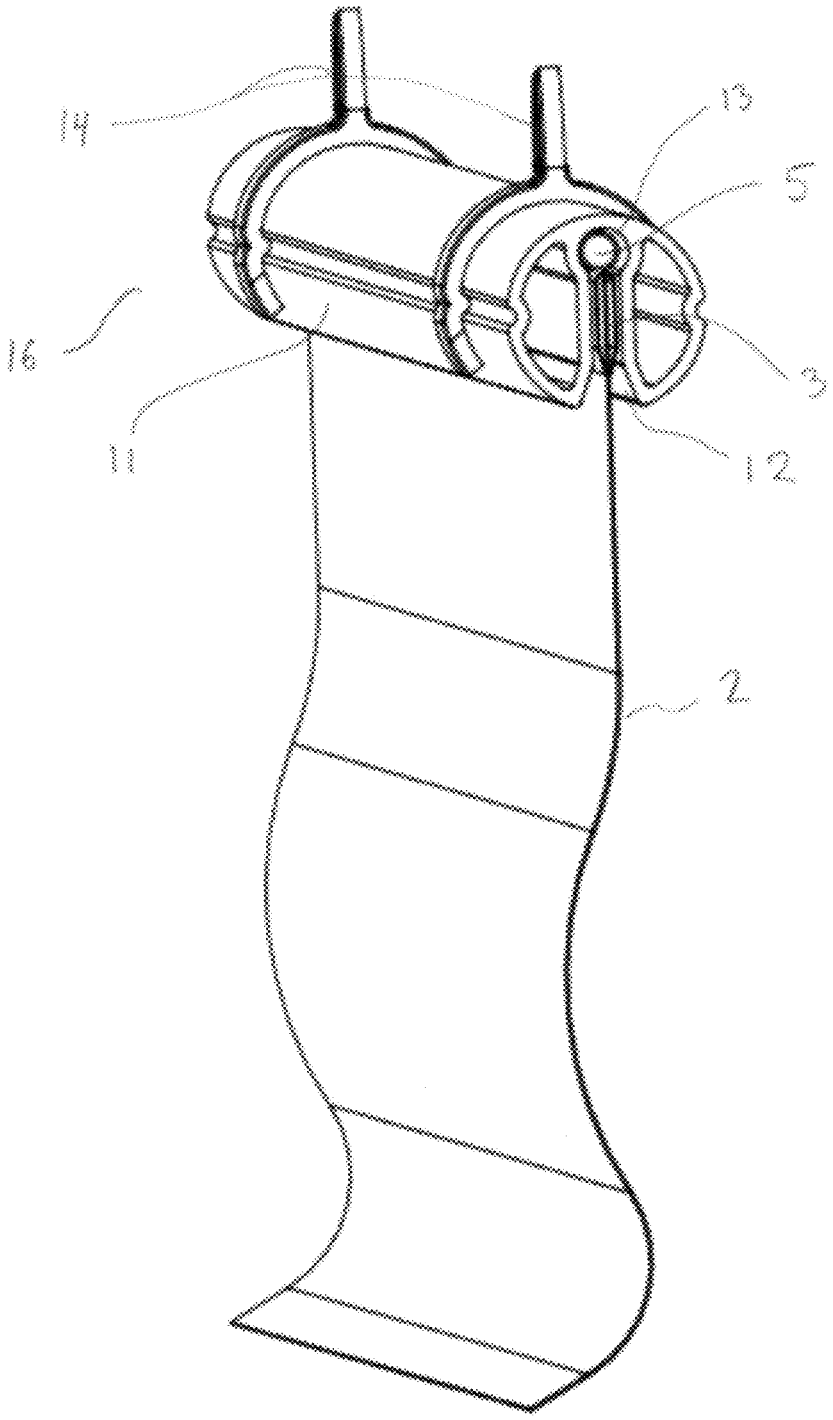
FIG. 4 shows, viewed obliquely from the side, a poster with a rail manufactured from a magnetic material, which is fastened to magnets built into a top fixture where the magnets are placed in a recess in relation to the surface, FIG. 4*a* being an enlarged view thereof.
Figure 4A:
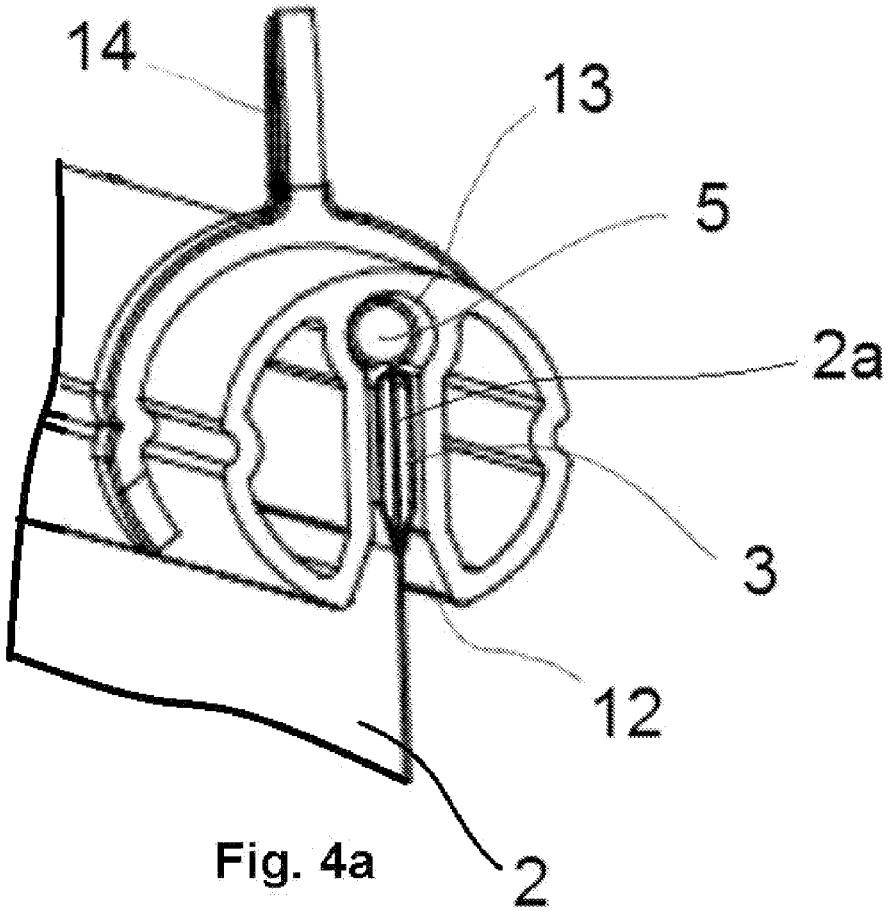

FIGS. 4 and 4*a* show an object consisting of a top fixture 16, which has a poster receiving channel 12 with a flared open end which is suitable for hanging of items 2 such as posters where these preferably should hang down from an edge 2*a* of the hanging poster received in the channel 12 where the hanging edge is provided with a rail 3, the rail 3 provided externally over a front and a back side of the hanging edge 2*a*. The top fixture is supported by a pair of hangers 14.

The rail 3 is manufactured from a magnetic material such as iron and will therefore attach to magnets 5 built into a passage 13 longitudinally extending within a top of the fixture, the passage appropriately shaped in the top fixture's external material 11, such that when rail 3 and magnets 5 come close to each other via magnetic connection between rail 3 and magnets 5, the rail resides entirely within an upper portion of the channel 12, which has a narrow opening leading the rail 3 to the magnets 5, as best seen in FIG. 4*a*.

It is a special and characteristic feature of the invention that the technique is used for fastening items 2 such as posters, photos or banners for objects 15,16 including top fixtures 16 or roll up units 15.

The invention claimed is:

1. A system for removably hanging one or more items comprising:

a longitudinally extending fixture having opposed ends, a longitudinally extending passage extending between the opposed ends;

one or more magnets disposed in the longitudinal passage, a receiving channel leading to the passage, and having an open lower end and an upper end in close proximity to the longitudinally extending passage, a rail attached externally over an edge of the one or more items to be hung, made of a magnetically attractive material, the rail configured for being slidably received within said receiving channel, wherein, after the rail is attached to the one or more items, the rail is insertable upwardly into the receiving channel, between the opposed ends, the magnets disposed within the passage magnetically engaging and holding the rail with the attached one or more items hanging therefrom, and wherein the receiving channel has an upper end with an opening leading into the longitudinal passage, the opening having a width smaller than a width of the one or more magnets disposed in the longitudinal passage, an upper end of the rail being extendable through the opening into contact with the one or more magnets contained within the longitudinal passage.

2. The system of claim 1 further comprising at least one hanger for supporting the fixture.

3. The system of claim 1 wherein the fixture has a generally cylindrical shape.

4. The system of claim 1 wherein the channel has a flared open end.

5. The system of claim 1 wherein the rail is configured to reside entirely within the receiving channel.

6. The system of claim 1 wherein the rail extends externally over a front and a back side of the edge on the one or more items, with the edge housed within the rail.

7. The system of claim 1 wherein the open end of the channel has a width which is narrower than a width of the fixture.

8. The system of claim 1 wherein the fixture is generally cylindrical, the longitudinal passage is circular and located beneath an upper surface of the fixture, the receiving channel extending downwardly therefrom towards an opposite lower surface of the fixture, the receiving channel having a length sufficient for receiving entirely the rail therein.

9. A method for removably hanging one or more items comprising:

providing a longitudinally extending fixture having opposed ends, a longitudinally extending passage extending between the opposed ends, one or more magnets disposed in the longitudinal passage, the fixture having a receiving channel leading to the passage, and having an open lower end and an upper end in close proximity to the longitudinally extending passage, attaching a hanging rail externally over an edge of the one or more items to be hung, made of a magnetically attractive material, the hanging rail configured for being slidably received within said receiving channel, upwardly inserting the hanging rail into the receiving channel, between the opposed ends, the magnets disposed within the passage magnetically engaging and holding the hanging rail in the fixture with the attached one or more items hanging downwardly therefrom, leading and guiding the hanging rail through the receiving channel into magnetic contact with the one or more magnets located in the passage without any sideways movement, wherein the receiving channel has an upper end with an opening leading into the longitudinal passage, the opening having a width smaller than a width of the one or more magnets disposed in the longitudinal passage, an upper end of the hanging rail being extendable through the opening into contact with the one or more magnets contained within the longitudinal passage.

10. The method according to claim 9 further comprising upwardly inserting the hanging rail through the receiving channel until the hanging rail magnetically engages with the one or more magnets located in the longitudinal passage, the hanging rail residing entirely within the receiving channel.

11. The method according to claim 9 further comprising fixing the hanging rail externally over a front and a back side of the edge on the one or more items, with the edge housed within the hanging rail.

12. The method of claim 9 wherein the open end of the channel has a width which is narrower than a width of the fixture.

13. The method of claim 9 wherein the fixture is generally cylindrical, the longitudinal passage is circular and located beneath an upper surface of the fixture, the receiving channel extending downwardly therefrom towards an opposite lower surface of the fixture, the receiving channel having a length sufficient for receiving entirely the hanging rail therein.

* * * * *